US005330475A

United States Patent [19]

Woodward et al.

[11] Patent Number: 5,330,475

[45] Date of Patent: Jul. 19, 1994

[54] MODULAR FUEL SENDER FOR MOTOR VEHICLE

[75] Inventors: Orrin A. Woodward, Davison; Edward A. Hantle, Caro; Christopher J. Mahoney, Birch Run, all of Mich.

[73] Assignee: General Motors Corporation, Detroit, Mich.

[21] Appl. No.: 158,344

[22] Filed: Nov. 29, 1993

[51] Int. Cl.[5] ..... F02M 33/00

[52] U.S. Cl. ..... 417/89; 123/509; 137/576

[58] Field of Search ..... 417/89, 78, 80; 123/509, 514; 137/576

[56] References Cited

U.S. PATENT DOCUMENTS

| | | | |
|---|---|---|---|
| 2,812,715 | 11/1957 | Redding et al. | 417/80 X |
| 3,319,570 | 5/1967 | Norris et al. | 417/80 |
| 4,521,164 | 6/1985 | Tuckey | 417/307 |
| 4,538,968 | 9/1985 | Kusakawa | 417/368 |
| 4,588,360 | 5/1986 | Tuckey | 417/366 |
| 4,591,311 | 5/1986 | Matsuda et al. | 415/53 T |
| 4,653,979 | 3/1987 | Schillinger | 415/53 T |
| 4,860,714 | 8/1989 | Bucci | 123/514 |
| 4,869,225 | 9/1989 | Nagata et al. | 123/509 |
| 5,070,849 | 12/1991 | Rich et al. | 123/509 |
| 5,139,000 | 8/1992 | Sawert | 123/514 |
| 5,218,942 | 6/1993 | Coha et al. | 123/514 |

*Primary Examiner*—Richard E. Gluck
*Attorney, Agent, or Firm*—Saul Schwartz

[57] ABSTRACT

A modular fuel sender including a reservoir in a fuel tank of a motor vehicle, an electric fuel pump in the reservoir, and a jet pump for aspirating fuel into the reservoir. The electric fuel pump includes a regenerative turbine pump having a pump channel around the periphery of an impeller and a bleed orifice between an inlet and a discharge of the pump channel for bleeding a mixture of fuel and vapor from the pump channel. The bleed orifice is connected a nozzle in the jet pump. The mixture of fuel and vapor bled from the pump channel issues as a jet stream from the jet pump nozzle for aspirating fuel into the reservoir.

4 Claims, 2 Drawing Sheets

MODULAR FUEL SENDER FOR MOTOR VEHICLE

FIELD OF THE INVENTION

This invention relates to apparatus for pumping fuel from a motor vehicle fuel tank.

BACKGROUND OF THE INVENTION

U.S. Pat. No. 5,218,942, issued Jun. 15, 1993 and assigned to the assignee of this invention, describes a modular fuel sender in a fuel tank of a motor vehicle. The modular fuel sender includes a reservoir mounted inside the fuel tank, an electric fuel pump mounted inside the reservoir pumping fuel from the reservoir to a fuel injection system of the vehicle, and a jet pump for aspirating fuel into the reservoir. In the modular fuel sender described in the aforesaid U.S. Pat. No. 5,218,942, the energy source for the jet pump is a constant fraction of the high pressure discharge of the electric fuel pump diverted directly to the jet pump. In other modular fuel senders, the energy source for the jet pump is a variable flow of return or excess fuel from the fuel injection system. Where the energy source is a fraction of high pressure discharge, low voltage performance of the electric fuel pump may be compromised. Where the energy source is return flow, the reservoir may become depleted. A modular fuel sender according to this invention uses a heretofore untapped energy source for the jet pump and is an improvement relative to the aforesaid modular fuel senders diverting return flow or a fraction of high pressure discharge to the jet pump.

SUMMARY OF THE INVENTION

This invention is a new and improved modular fuel sender for a motor vehicle including a reservoir in a fuel tank of the vehicle, an electric fuel pump in the reservoir, and a jet pump for aspirating fuel into the reservoir. The electric fuel pump includes a regenerative turbine pump and an electric motor. The regenerative turbine pump includes a housing, an impeller drivingly connected to an armature shaft of the electric motor, an annular pump channel in the housing around the periphery of the impeller, and a bleed orifice in the housing through which a mixture of vapor and liquid fuel is bled from the pump channel at a pressure below the discharge pressure of the turbine pump. The vapor and liquid mixture bled from the pump channel is conducted to a nozzle of the jet pump from which it issues as a jet stream into a venturi passage of the jet pump for aspirating fuel into the reservoir.

DESCRIPTION OF A PREFERRED EMBODIMENT

Figure 1:
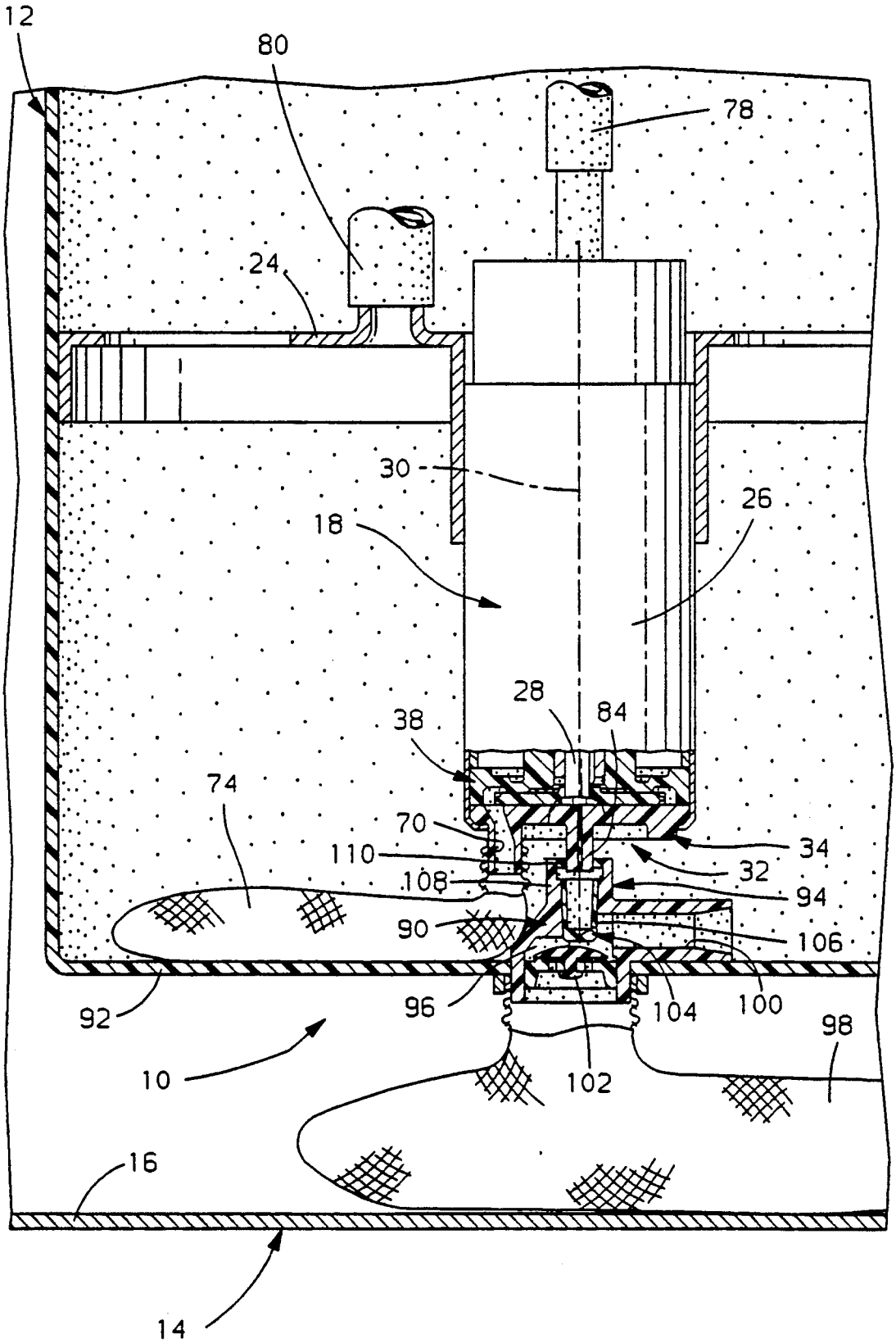
FIG. 1 is a schematic, partially broken-away elevational view of a modular fuel sender according to this invention.

Referring to the drawings, a modular fuel sender 10 according to this invention includes a reservoir 12 mounted in a fragmentarily illustrated fuel tank 14 of a motor vehicle, not shown, near a bottom panel 16 of the tank. An electric fuel pump 18 is mounted on a horizontal separator 24 of the reservoir and includes a tubular metal shell 26, an electric motor in the shell having an armature shaft 28 rotatable about a vertical centerline 30 of the shell, and a regenerative turbine high pressure pump 32. The pump 32 has a disc-shaped lower housing 34 bearing against a lip 36 at the end of the shell 26 and a disc-shaped upper housing 38 above the lower housing. A flat side 40 of the upper housing 38 bears against a flat side 42 of the lower housing and the upper and lower housings are clamped against each other and against the lip 36 by a flux ring 44 of the electric motor.

Figure 2:
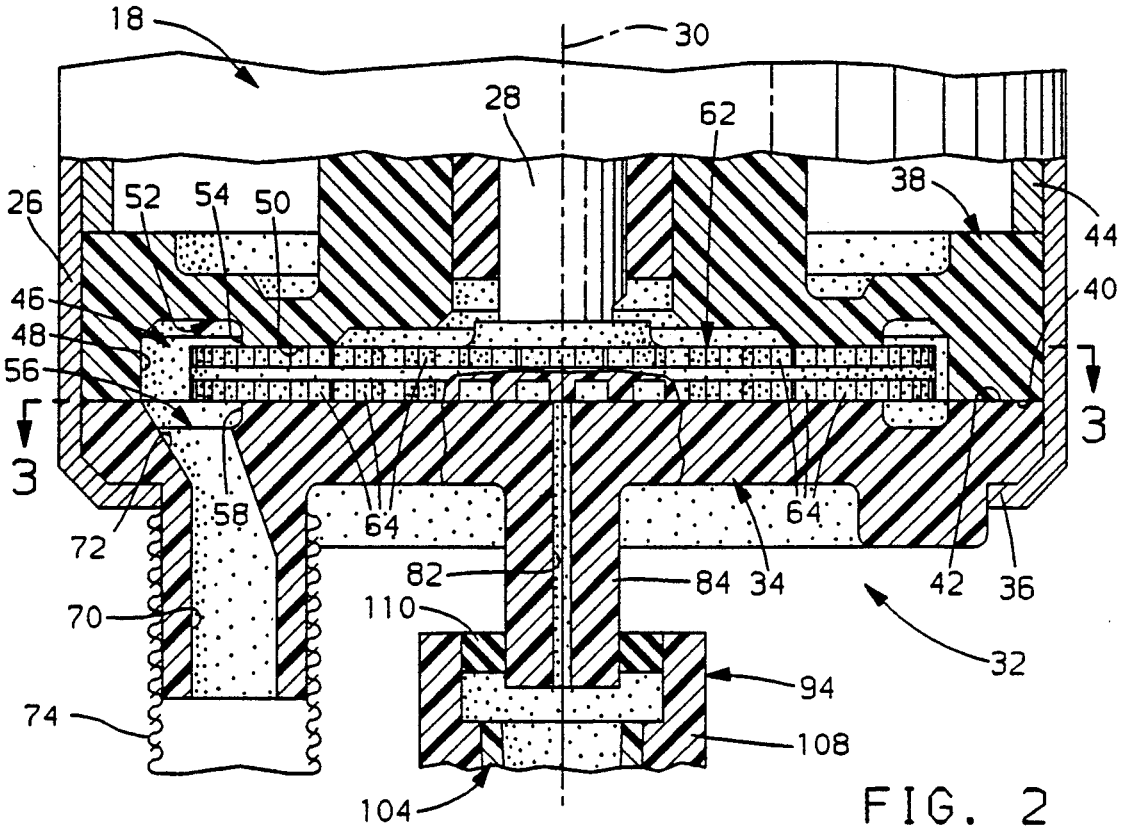
FIG. 2 is an enlarged view of a portion of FIG. 1.

As seen best in FIG. 2, a cavity 46 in the flat side 40 of the upper housing 38 has a substantially cylindrical side wall 48 and a circular bottom wall 50. An annular first groove 52 in the bottom wall 50 around the periphery thereof has an outer edge contiguous with the side wall 48 of the cavity 46 and an inner edge 54. An annular second groove 56 in the flat side 42 of the lower housing 34 faces the first groove 52 and has an outer edge contiguous with the side wall 48 and an inner edge 58 interrupted by a step 60. The inner edge 54 of the first groove has a corresponding step, not shown, opposite the step 60.

A disc-shaped impeller 62 having a diameter less than the diameter of the side wall 48 of the cavity 46 is disposed in the cavity between the bottom wall 50 thereof and the flat side 42 of the lower housing. The impeller is drivingly connected to the armature shaft 28 of the electric motor and has a plurality of closed-vane impeller vanes 64 around its periphery. A radial protrusion 66, FIG. 3, on the side wall 48 defines a close running seal at the circumference of the impeller 62. The groove 56 is interrupted by a seal surface 68 in the plane of the flat side 42 of the lower housing 34 aligned with the radial protrusion 66. The groove 52 is interrupted by a corresponding seal surface, not shown, facing the seal surface 68. The grooves 52,56 cooperate in defining a regenerative turbine pump channel around the vanes 64 of the impeller interrupted by a so-called stripper defined by the radial protrusion 66, the seal surface 68 on the lower housing, and the corresponding seal surface on the upper housing 38.

A passage 70 in the lower housing 34 intersects the groove 56 at an inlet port 72 of the pump 32 adjacent the aforesaid stripper and defines an upstream end of the pump channel. A strainer 74 is attached to the lower housing over the distal end of the passage 70. A discharge port, not shown, in the upper housing adjacent the opposite side of the aforesaid stripper defines a downstream end 76 of the pump channel. In conventional regenerative turbine pump fashion, clockwise rotation, FIG. 3, of the impeller induces inflow of fuel from the reservoir to the pump channel through the strainer 74, the passage 70 and the inlet port 72. The fuel is conducted by the impeller 62 from the upstream end of the pump channel to the downstream end 76 where it is expelled from the pump channel at high pressure through the discharge port. High pressure fuel is discharged from the fuel pump 18 through a high pressure hose 78, FIG. 1. Overage or excess fuel not consumed by the engine is returned to the reservoir below the partition 24 through a low pressure return hose 80.

Figure 3:
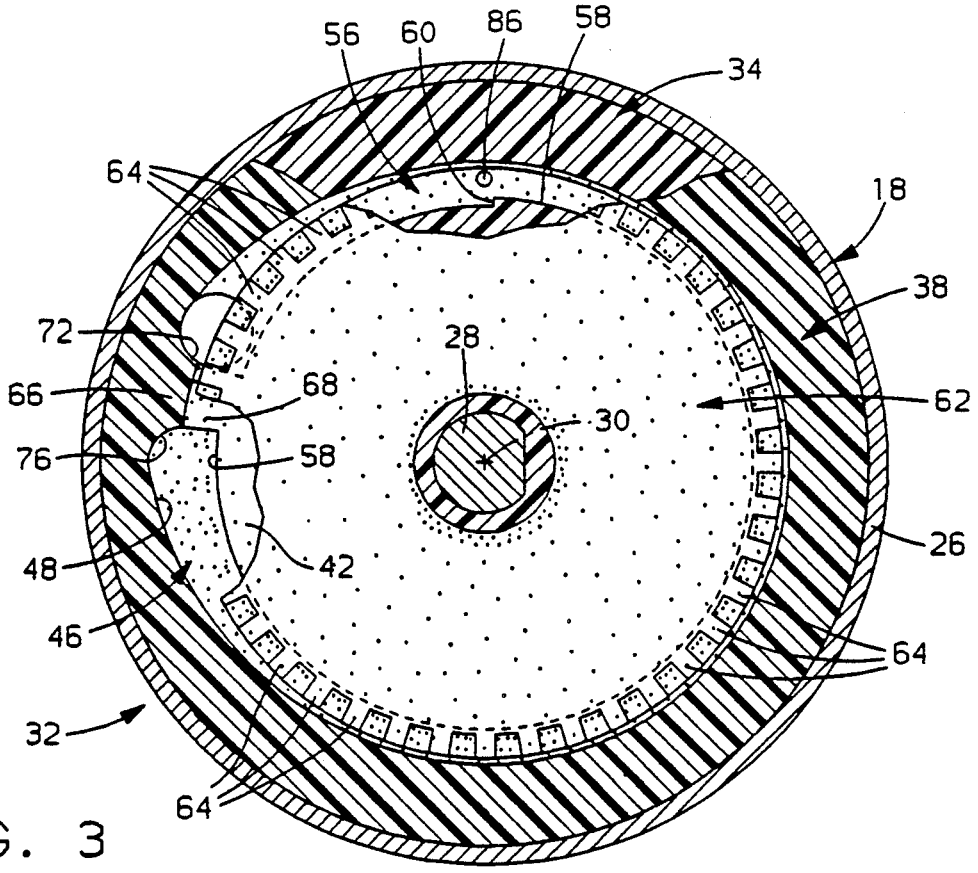
FIG. 3 is a sectional view taken generally along the plane indicated by lines 3—3 in FIG. 2.

As seen best in FIGS. 2–3, a passage 82 through a boss 84 on the lower housing 34 intersects the pump channel at a bleed orifice 86 on the upstream side of the step 60 in the inner edge 58 of the groove 56. The reduction in cross-sectional area of the pump channel at the step 60, and at the corresponding step, not shown, on the opposite side of the impeller, concentrates or aggregates at the bleed orifice 86 any vapor entrained in the fuel entering at the inlet port 72. The bleed orifice 86 and the passage 82, in turn, define an escape or bleed path for the vapor thus aggregated.

A jet pump 90 is disposed between the fuel pump 18 and a bottom 92 of the reservoir 12 and includes a plastic housing 94 having an inlet chamber 96 open to the fuel tank through the bottom 92 of the reservoir and through a strainer 98. A venturi-shaped passage 100 in the housing 94 is open to the inlet chamber 96 and to the reservoir 12. An umbrella valve 102 prevents back flow from the inlet chamber 96 into the fuel tank. A nozzle 104 of the jet pump is mounted on the plastic housing 94 with an orifice 106 aimed at an inboard end of the passage 100. Above the nozzle 104, the plastic housing 94 has a neck portion 108 which surrounds the boss 84 and is sealed with respect thereto by a rubber gasket 110.

When the electric fuel pump is on, the aforesaid mixture of fuel and vapor bled from the regenerative turbine pump channel through the bleed orifice 86 enters the neck portion 108 of the jet pump housing and is thereafter expelled from the jet pump orifice 106 as a jet stream into the inboard end of the venturi passage 100. The jet stream issuing from the jet pump orifice 106 aspirates fuel from the inlet chamber 96 into the reservoir. For proper operation, the bleed orifice 86 must have at least twice the cross sectional flow area of the jet pump orifice 106 and the fuel and vapor mixture discharged from the bleed orifice 86 must have a pressure head of at least 15 kilopascals.

Conducting the mixture of fuel and vapor from the bleed orifice 86 to the jet pump nozzle 106 improves the efficiency of the modular fuel sender 10 and is an important feature of this invention. That is, because of the downstream location of the bleed orifice 86 relative to the inlet port 72, the pressure of the fuel and vapor mixture aggregated at the bleed orifice is elevated relative to the inlet port. Heretofore, where the mixture of fuel and vapor was simply bled or vented back to the fuel tank, the energy required to effect the pressure increase of such mixture was lost. That amount of energy, however, corresponds approximately with the energy requirements of the jet pump 90 when the latter is dedicated to only filling the reservoir 12. Accordingly, the fuel and vapor mixture bled or vented through the orifice 86 represents a substantially free, i.e. otherwise wasted, source of energy for the jet pump which does not compromise the performance of the fuel pump 18 under low voltage conditions and which is not subject to flow variations characteristic of return flow.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege is claimed are defined as follows:

1. In a modular fuel sender including a reservoir in a fuel tank of a motor vehicle, a jet pump having an inlet chamber connected to said fuel tank, a venturi passage between said inlet chamber and said reservoir, and a nozzle with an orifice aimed at said venturi passage, and an electric fuel pump in said reservoir including a regenerative turbine pump and an electric motor, said regenerative turbine pump further including an impeller drivingly connected to said electric motor, a housing defining a substantially annular pump channel around said periphery of said impeller, an inlet port at an upstream end of said pump channel connected to said reservoir for admitting fuel at ambient pressure to said pump channel, a discharge port at a downstream end of said pump channel for discharging fuel therefrom at a discharge pressure, and a bleed orifice in said housing open to said pump channel between said inlet port and said discharge port for bleeding a mixture of liquid fuel and vapor from said pump channel at a pressure between ambient and said discharge pressure, the improvement comprising:

means connecting said bleed orifice to said nozzle in said jet pump so that said mixture of fuel and vapor bled from said pump channel issues from said orifice in said jet pump nozzle as a jet stream and into said venturi passage in said jet pump whereby fuel from said inlet chamber is aspirated into said reservoir through said venturi passage.

2. The modular fuel sender recited in claim 1 wherein said impeller of said regenerative turbine pump is a closed vane impeller.

3. The modular fuel sender recited in claim 2 wherein said housing of said regenerative turbine pump further defines means for aggregating at said bleed orifice vapor entrained in fuel entering said pump channel at said inlet port.

4. The modular fuel sender recited in claim 3 wherein said means for aggregating at said bleed orifice vapor entrained in the fuel entering said pump channel at said inlet port includes:

means between said bleed orifice and said down stream end of said pump channel defining a reduction in the cross-sectional flow area of said pump channel.

* * * * *